US005188381A

United States Patent [19]

Kho

[11] Patent Number: 5,188,381

[45] Date of Patent: Feb. 23, 1993

[54] WHEEL HOLDING BRACKET ASSEMBLY FOR SUITCASES

[76] Inventor: Dick T. Kho, P.O. Box 34454, West Los Angeles, Calif. 90034

[21] Appl. No.: 660,067

[22] Filed: Feb. 25, 1991

Related U.S. Application Data

[63] Continuation-in-part of Ser. No. 512,426, Apr. 23, 1990, abandoned.

[51] Int. Cl.[5] ..... B62B 1/12

[52] U.S. Cl. ..... 280/37; 24/647; 74/527; 74/529; 190/18 A; 280/7.12; 280/47.26; 292/DIG. 38; 403/330

[58] Field of Search ..... 280/37, 47.131, 47.17, 280/47.24, 47.26, 7.12, 7.13, 8, 767; 190/18 A; 24/647; 292/DIG. 38, 204, 216; 74/527, 529; 403/330, 326, 328

[56] References Cited

U.S. PATENT DOCUMENTS

| | | | |
|---|---|---|---|
| Re. 10,995 | 4/1889 | Spooner | 24/647 |
| 387,009 | 7/1888 | Rammoser | 24/647 |
| 2,881,007 | 4/1959 | Karwatt et al. | 280/47.131 |
| 3,997,038 | 12/1976 | Walker | 190/18 A |
| 4,900,043 | 2/1990 | Kho | 280/37 |

FOREIGN PATENT DOCUMENTS

| | | | |
|---|---|---|---|
| 580934 | 10/1976 | Switzerland | 190/18 A |

*Primary Examiner*—Eric D. Culbreth
*Attorney, Agent, or Firm*—Julius Rubinstein

[57] ABSTRACT

This is a device for detachably attaching large wheels to the bottom of a suitcase. The wheels are connected together by a common axle. A bracket is molded or attached to the bottom of the suitcase and the bracket has axle receiving slots formed therein. A lever is pivotally mounted on the bracket, and when the axle of the wheels is inserted in the axle receiving slots, the lever is pivoted in a direction which closes off the entrance to the slot and locks the axis in the slot. A device is provided for pivoting the lever in a direction which allows the axle to be removed from the slot.

3 Claims, 3 Drawing Sheets

WHEEL HOLDING BRACKET ASSEMBLY FOR SUITCASES

This is a continuation in part of a U.S. patent application Ser. No. 07/512/426 filed Apr. 23, 1990, abandoned.

This invention relates generally to a bracket on suitcases for releasably holding a wheel and axle assembly to the bracket.

BACKGROUND AND BRIEF SUMMARY

This invention is an improvement over the invention described in U.S. Pat. No. 4,900,043 and U.S. patent application Ser. No. 512,426 by this inventor. The bracket described in U.S. Pat. No. 4,900,043 had a weakness in that it was not strong enough to bear heavy loads in a suitcase. This is because the connecting strip 45 shown in FIG. 5 and 8 of the above described patent had to flex in order to release the axle, and the repeated bending was of a magnitude such that the connecting strip 45 frequently broke. Consequently the bracket described in the prior patent needed improvement.

U.S. patent application Ser. No. 512,426 solved this problem but the structure described in U.S. patent application Ser. No. 512,426 was expensive to make. The current patent application is simpler in design and more economical to manufacture.

What is needed therefore and comprises an important object of this invention is to provide a locking lever for an improved bracket for suitcases which is strong enough to hold a heavily loaded suitcase being pulled over a rough surface. In one improved version of the bracket, only a small part of the axle retaining member flexes when the axle is inserted in the axle receiving slot and the flexure of this part is independent of the weight of the suitcase so the bracket won't break.

As will be seen below, in another improved version described below, the flexing part of the bracket is located away from the axle receiving slots so that it is independent of the weight of the suitcase. In addition, the wheels attached to the bracket assembly can be easily locked onto the bracket or removed from it by a simple rotation of a lever.

The principle object of this invention is to provide a bracket which can be attached to a suitcase or luggage so designed to enable an axle with wheels to be easily attached or removed from the bracket.

Other objects of this invention will become more apparent when better understood in the light of the accompanying drawings and specification wherein.

Figure 9:
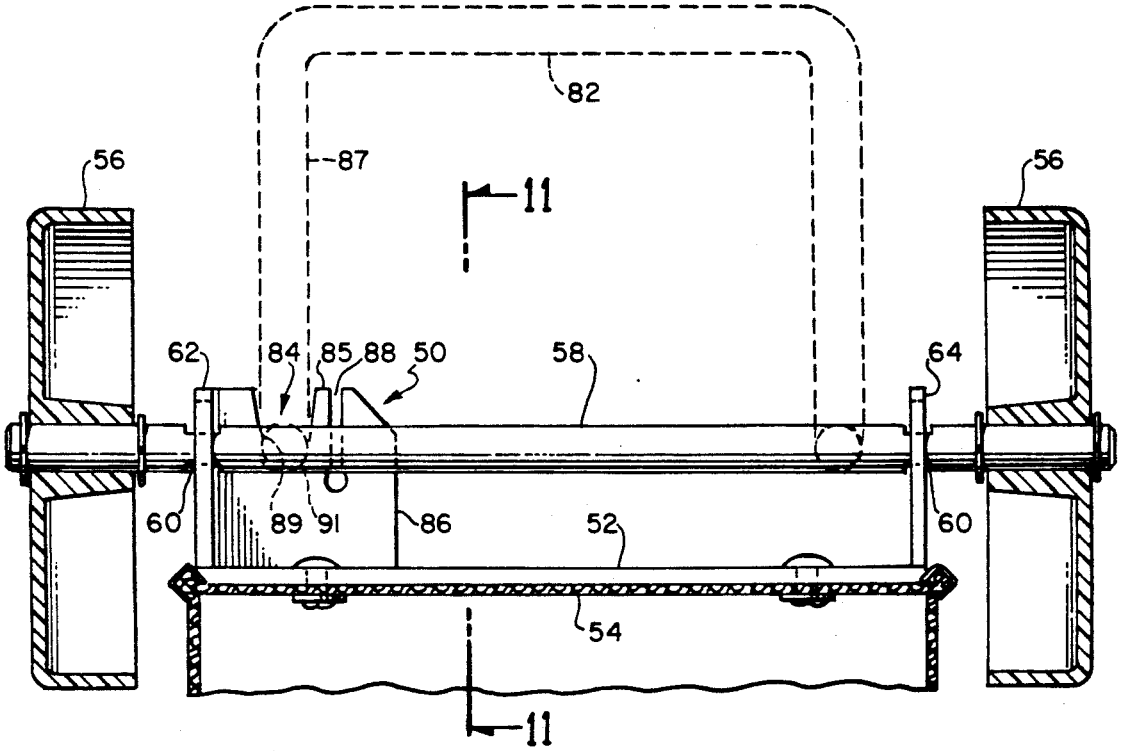

FIG. 9 discloses an elevational view partly in section of a modified bracket assembly secured to the bottom of a suitcase by rivets with the wheel and axle assembly attached thereon.

Figure 10:
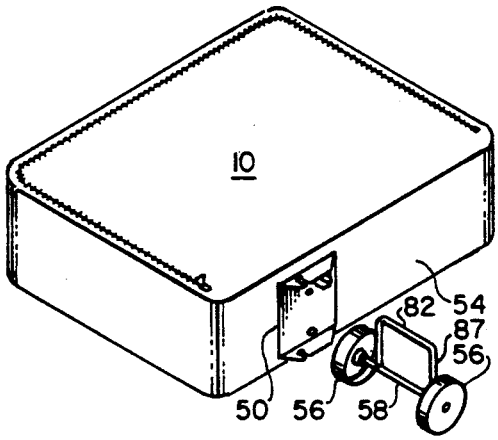

FIG. 10 discloses a perspective view of a fabric suitcase with the modified bracket assembly secured to its base and the modified wheel and bracket assembly for use with this bracket.

Figure 11:
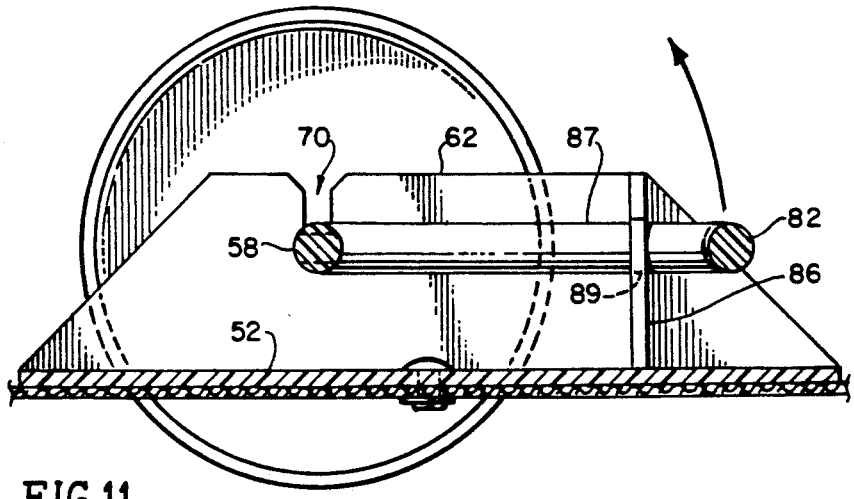

FIG. 11 is a cross sectional view taken on the line 11—11 of FIG. 9 showing the wheel and axle assembly within the bracket.

Figure 12:
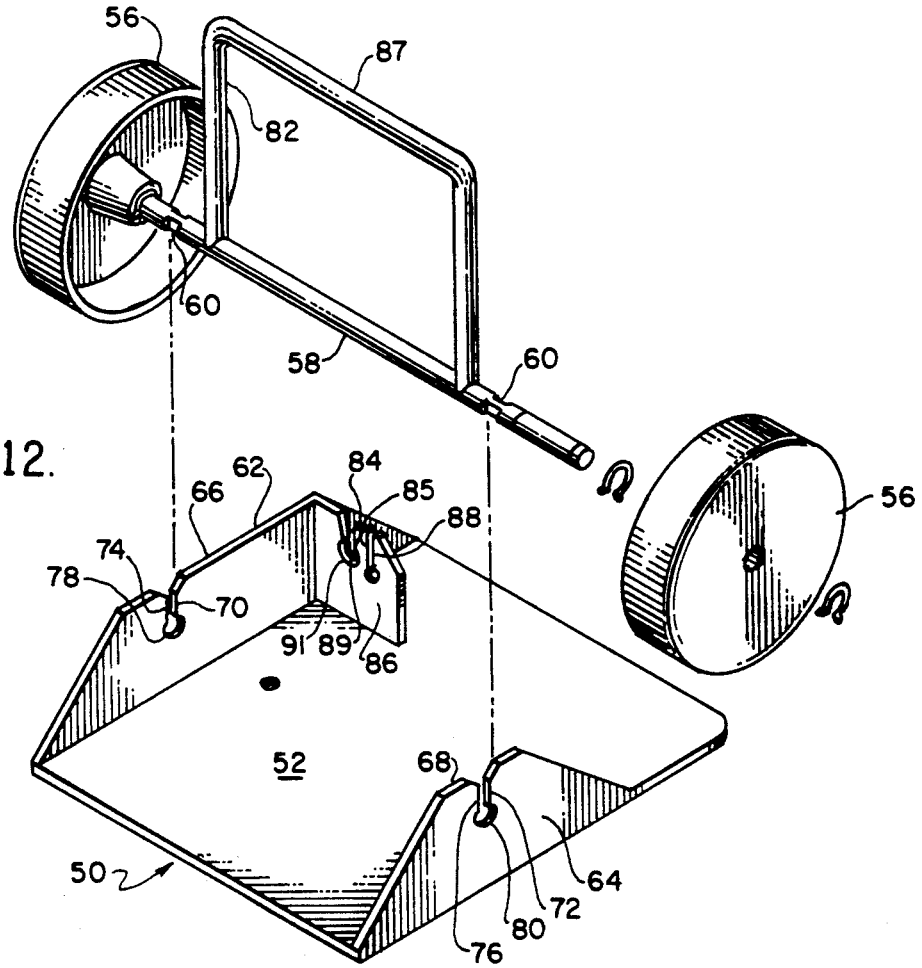

FIG. 12 is an exploded perspective view of the wheel and axle assembly in an upright position to be inserted in the bracket.

Figure 13:
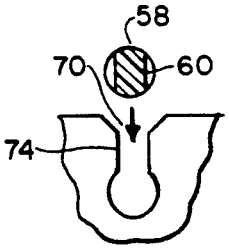

FIG. 13 is a partial sectional view showing the orientation of the axle as it is being inserted in an axle receiving slot in the bracket.

Figure 14:
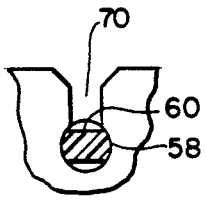

FIG. 14 is a partial sectional view showing the orientation of the axle after it has been inserted and locked in the axle receiving slot in the bracket.

Figure 15:
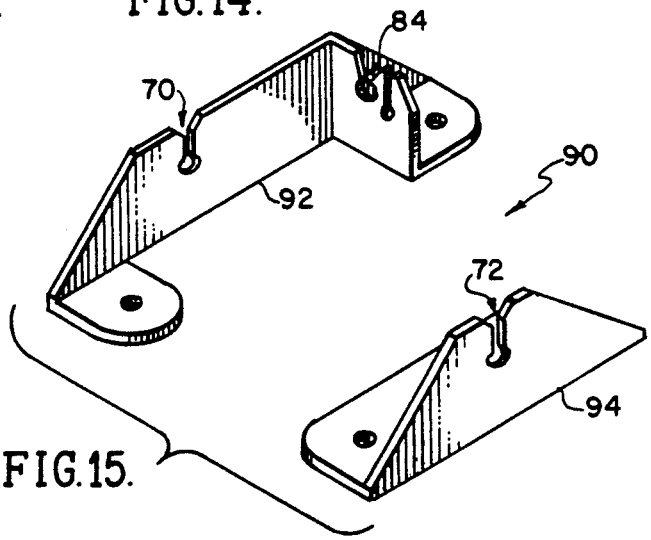

FIG. 15 is a perspective view of a modified bracket formed in two parts for attachment to a hard bodied suitcase.

Figure 1:
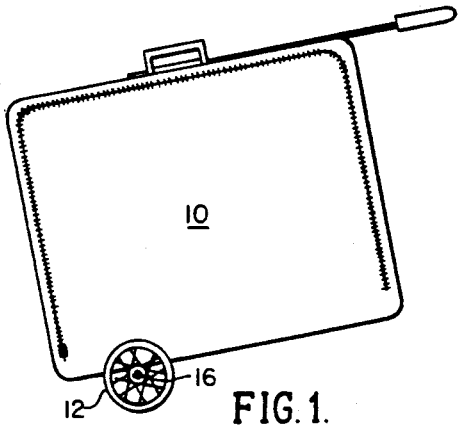
FIG. 1 is a side elevational view disclosing a fabric suitcase having the improved bracket assembly attached to it and attached to large wheels for towing the suitcase over rough ground.
Figure 2:
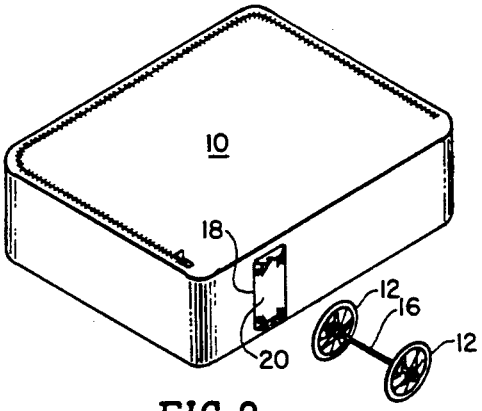
FIG. 2 is a perspective view of the suitcase shown in FIG. 1 and also disclosing a perspective view of the wheel and axle assembly for use with the suitcase.
Figure 3:
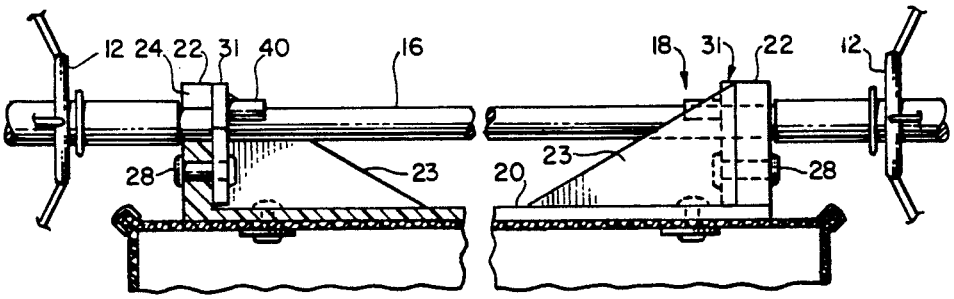
FIG. 3 is a partial elevational sectional view of the wheel and axle assembly mounted in a bracket assembly which extends across the bottom portion of the suitcase.
Figure 5:
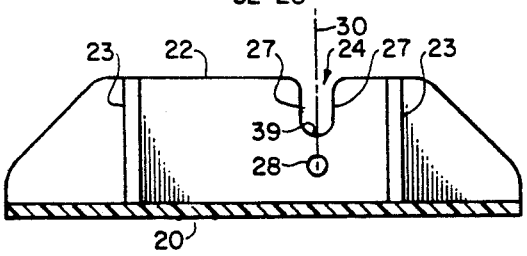
FIG. 5 is a cross sectional view of one end of the bracket assembly showing the axle receiving slot.

Referring now to FIG. 1 of the drawing, a fabric suitcase 10 is shown with a pair of wheels 12 mounted on a common axle 16. The axle retaining bracket or bracket assembly 18 for the axle, shown in FIGS. 2 and 3 is secured by any suitable means such as rivets to the bottom of the suitcase. For a cloth suitcase 10, the bracket assembly 18 comprises a flat strong base plate 20 secured to the bottom of the suitcase by rivets or nuts and bolts and the like (see FIG. 3) and transverse walls 22 terminating in edges 26 on each end strengthened by gussets 23, (see FIGS. 3 and 5). However it is contemplated that the entire suitcase including the bracket assembly could be molded in one piece, thus eliminating the need for a separate construction of the bracket assembly and the labor cost of attaching it to the suitcase.

Figure 6:
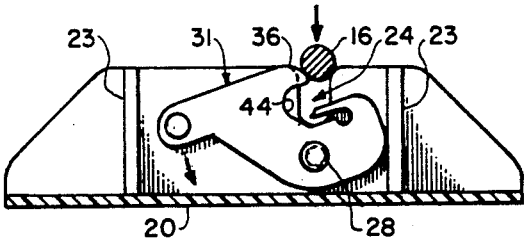
FIG. 6 is a cross sectional view similar to FIG. 5 but with the improved locking lever pivotally mounted on the upwardly projecting portion of the bracket, and the axle entering its slot.
Figure 7:
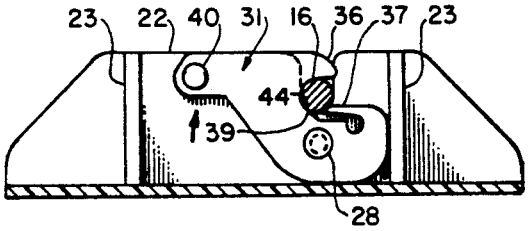
FIG. 7 is a cross sectional view showing the axle seated in its slot and locked in position.
Figure 8:
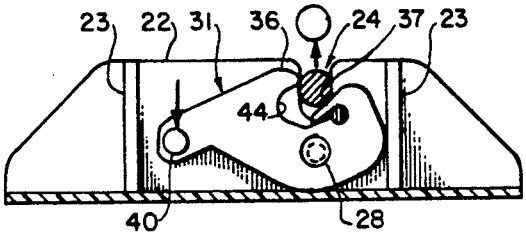
FIG. 8 is a cross sectional view similar to FIGS. 6 and 7 but showing the axle being released from its locked position and removed from the slot.

For purposes of illustration, the drawings shown in FIGS. 4 to 8, 9 and 11, and 12 to 15 are shown upside down to better illustrate the features of the invention. For example, the arrow shown in FIG. 6 is directed upward toward the bottoms of the suitcase, and the arrow in FIG. 8 is directed downward, away from the bottom of the suitcase.

The end walls 22 of the bracket assembly 18 have first axle receiving slots 24 formed in each wall (see FIGS. 5 to 8). As shown in FIGS. 6 and 7, the bracket is designed so the axle 16 of the wheel assembly 14 can be locked in the axle receiving slots 24. The axle receiving slots have generally parallel walls 27 terminating in a bottom wall or semi- circular seats 39.

At least part of the bracket assembly 18 includes axle retaining levers 31 which are pivotally mounted on the two transverse walls 22 of the bracket assembly 18 by means of rivets 28. Rivet 28 is mounted on the center line between the parallel walls of each slot 24 for reasons to become apparent below (see FIG. 5).

The axle returning lever 31 comprises a part 32 and a part 34. Part 32 of the lever 31 is elongated and has a lever edge 33. One end of the edge 33 of part 32 of the lever is shaped to form a first cam 36 which when the lever is mounted on a transverse wall 22 of the bracket assembly 18, extends slightly into the entrance to the slot 24 (see FIG. 6). A handle 40 is mounted on the opposite end of the lever part 32.

Figure 4:
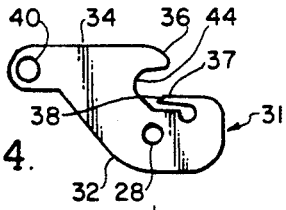
FIG. 4 is an elevational view of the improved pivotally mounted locking lever used for locking the axle within the bracket assembly.

The lever edge 33 of lever 31 extends beyond the first cam and curves back and around to define part 34 of the lever 31 and a second axle receiving slot 44 formed between parts 32 and 34 of the lever 31 (see FIG. 4). The levers 31 are pivotally mounted on pivots 28 on each transverse wall 22 and the pivots are positioned on the center lines 30 between the parallel walls 27 of the first slots 24 for reasons to be described below. In addition the lever 31 is provided with a resilient flexing member 37 in the form of a thin narrow peninsula terminating in cams 38 near the bottom walls 39 of the first slots 24. The thin peninsula members 37 extends into the slots 24 adjacent the bottom walls 39 from the end of the levers 31 opposite the handles 40 (see FIGS. 6 and 7). The handles 40 shown in FIG. 3 provide a means for pivoting the lever in the direction shown in FIG. 8 to permit the axle 16 to be removed from the first axle receiving slots 24.

Referring now to FIG. 6, when an axle 16 is inserted in the first axle receding slot 24, it first encounters the first cam 36 on the lever 31 which extends slightly into slot 24. This encounter pivots the lever 31 in the direction shown by the curved arrow in FIG. 6, thereby permitting the axle 16 to enter the first slot 24. As the axle moves further into the first slot 24 it encounters a second cam member formed on the distal end of the thin peninsula like flexing member 37 close to the bottom wall 39 of the slot 24. This encounter bends the flexing member so the flexure of the member 37 is limited by the bottom wall 39 which is well below its breaking limit so the force exerted on the flexing member is independent of the weight in the suitcase. In addition the engagement of the axle 16 with the second cam member 38 rotates lever 31 in the direction shown by the curved arrow in FIG. 7 thereby forcing the axle into the second axle receiving slot 44 so that the axle is locked both in the first axle receiving slot 16 and the second axle receiving slot 24.

As stated above, the rivets 18 on which the levers 31 pivot are on the center lines of the first slots 24. With this arrangement. The axles cannot be pulled out of the slots 24 because no rotative force can be exerted on the levers 31.

To release the axle, the levers 31 must be rotated in a counter clockwise direction as shown in FIG. 8. To do this the handles 40 of the levers 31 are pushed down causing the levers 31 to pivot in the direction indicated by the curved arrow shown in FIG. 8 so the cams 36 move out of the entrance to the slots 24 thereby releasing the axles 16.

In a second embodiment, the bracket 50 shown in FIG. 12 includes a planar support 52 which is secured to the bottom 54 of the suitcase by any suitable means such as screws or rivets (see FIG. 9). The wheels 56 are connected together by an axle 58. Referring to FIG. 12, it is noted that a small section of the axle 58 is near its ends are flat for reasons to become apparent below.

The opposite ends of the brackets 50 first and second transverse flanges or portions 62 and 64, and a third transverse flange or portion 86 situated in a plane transverse to portions 62 and 64 (see FIG. 12). Slots 70 and 72 are formed in edges 66 and 68 of portions. Slots 70 and 72 are formed in the edges 66 and 68 of portions 62 and 64 (see FIGS. 9, 11, and 12). Slots 70 and 72 have narrow entrance portions 74 and 76 each terminating in axle receiving holes 78 and 80.

The length of the flat portions 60 of the axle is equal to the diameter of the axle and the width of the flat portion of the axle is less than width of the narrow entrances 74 and 76 to slots 70 and 72 (see FIGS. 13 and 14). This permits the axle to be rotated so the flat portions of the axle can pass through the narrow entrances to the slots 70 and 72 (see FIGS. 13) and when the axle is rotated as shown in FIG. 14, the axle is locked in the slots because the length of the flat portions of the axle is greater than the width of the narrow entrances of the slots.

The axle 58 includes a generally U-shaped handle or axle like device 82 attached to the axle near the flat portions 60 (see FIG. 12).

When the axle like device or handle 82 is in the position shown in FIG. 12, the axle 58 is positioned so that the flat portions 60 of the axle are aligned with the narrow entrances 74 and 76 to slots 70 and 72 (see FIG. 13). In this way the axle 58 can be inserted in the slots 70 and 72. When the handle 82 is rotated to the horizontal position shown in FIG. 11, the axle 58 is in the position shown in FIG. 14. In this position the flat portions 60 of the axle are transverse to the narrow entrances to the slots 70 and 72, and as stated above, flat portions 60 of the axle are wider than the width of the narrow entrances to slots 70 and 72, the axle is locked in the slots 70 and 72 of the bracket 50. As shown in FIGS. 9 and 12, the wheels 56 are attached to the ends of the axle by any suitable means thus the suitcase can be easily pulled along rough ground or uneven surfaces due to the larger diameter of the wheels.

A slot 84 for receiving the cross bar or axle like device 87 of the handle 82 is formed in flange or transverse portion 86. This slot is dimensioned to receive the bar 87 of the handle 82 when the handle is in the horizontal position, as shown in FIG. 11. To lock the bar 87 of the handle in the slot 84, a narrow slot 88 is formed next to the slot 84 to provide a resilient flexing wall 85 integral with at least part of the bracket 50 for slot 84 (see FIG. 12). The slot 84 is shaped so it has a narrowest part 89 and the distance between the narrowest part of slot 84 is slightly less than the diameter of the bar 87. With this arrangement, when the bar 87 is forced into the slot 84, it causes the wall 85 of slot to flex or deflect so it increases the width of the narrowest part 89 enough to permit the bar 87 to pass by the narrowest part of slot 84 and reach the bottom wall or bar receiving portion 91 at the end portion of the slot 84. Then the resiliency 85 of wall of slot 84 causes the wall 85 to move back to its original position locking the handle 82 in a horizontal position with the bar 87 locked in slot 84 and the narrow parts 60 of the axle 58 locked in the axle holes 78 and 80. In this way the handle will lie against the bottom of the luggage while it is being towed on the wheels 56.

To remove the wheel assembly from the bracket 50, the handle 82 is rotated to the dotted position shown in FIG. 9 so the flat portions 60 of the axle 58 are aligned with the narrow entrances 74 and 76 of the slots 70 and 72. In this way the axle can be easily pulled through the narrow entrances 74 and 76, thereby freeing the axle and the wheels from the bracket 50.

The bracket and wheels shown in FIG. 10 are associated with a fabric suitcase, but the principles of this invention are also applicable to a rigid walled suitcase. For this purpose the bracket 90 for the hard surface luggage is formed in two parts 92 and 94 (see FIG. 15). The separate parts of bracket 90 are fastened to the bottom of the luggage by any conventional means. Except for the fact the bracket 90 is formed in two parts, it functions exactly the same as bracket 50 shown in FIG. 12.

Having described the invention, what I claim as new is:

1. An axle retaining bracket for holding a wheel and axle assembly on a suitcase comprising a planar support and spaced transverse portions each terminating in an edge, each of said transverse portions having a first axle receiving slot formed therein, each first axle receiving slot having an entrance at said edge of said transverse portion with generally parallel walls connected by a bottom wall, said parallel walls spaced far enough apart to receive the axle of a wheel assembly, a lever pivotally mounted on the transverse portion of each bracket, each lever having a first portion and a second portion, said first portion of each lever elongated with opposite ends and a lever edge, a handle formed on one end of said lever, a curved first cam formed on said lever edge at the opposite end of said lever, said first cam projecting into the said entrance to each slot partially blocking the entrance to the slot, said edge of said first cam reversing direction and curving back and around to define the second portion of said lever and a second axle receiving slot formed between the said first and a second portions of said lever, a thin elongated flexing member, said thin elongated flexing member having a distal end, said distal end of said thin elongated member positioned near the bottom wall of said first axle receiving slot and shaped to form a second cam, said second cam positioned so contact with an axle entering the slot causes the thin elongated member to flex, said thin elongated member close enough to said bottom wall so that the flexure of said thin elongated member is limited by the bottom wall of said slot and is below its breaking limit whereby said thin elongated member is not affected by the weight carried by the suitcase, said first cam shaped in such a way that when an axle is inserted in said slot it encounters said first cam at the entrance to said first axle receiving slot thereby pivoting said lever in one direction causing said first cam to move away from the entrance to said slot to permit said axle to enter said slot, said second cam positioned so when an axle moves toward the bottom wall of said slot it encounters said second cam at the distal end of said thin elongated member, said second cam positioned so the engagement of an axle with said second cam pivots said lever in a direction opposite to said one direction causing said first cam to completely cover the entrance to said slot whereby the axle is locked in said first and second axle receiving slots, the pivot of said lever at the center line of said axle receiving slots between said parallel walls whereby force directed against said first cam has no pivotal effect on said lever, said handle positioned so when force is exerted on said handle in said one direction the lever rotates in a said one direction which opens the entrance to said first slot so the axle can move completely out of said first slot and separate from said bracket.

2. An axle retaining bracket integrally formed with a suitcase, said bracket having an edge, a first axle receiving slot formed in said bracket edge and sized to receive the axle of a wheel assembly, said axle receiving slot having parallel walls connected by a bottom wall, a pivot, said pivot located at the center line between said parallel walls, a lever mounted on said bracket on said pivot, said lever having a first portion and a second portion and a lever edge, a first cam formed on said lever edge and located near the entrance to said slot partially blocking the entrance to said axle receiving slot, said cam shaped so contact with an axle rotates said lever in one direction which moves said first cam away from the entrance to said axle receiving slot permitting an axle to enter said slot, said lever edge of said first lever reversing direction and curving back and around to define a second cam receiving slot and said second part of said lever, a thin peninsula shaped member spaced above but close to the bottom of said first axle receiving slot, a second cam formed on the distal end of said thin peninsula shaped member, whereby when an axle enters said first axle receiving slot it encounters said second cam causing said peninsula like member to flex and exert a force on said lever which rotates said lever in a direction opposite to said one direction so said first cam blocks the first axle receiving slot preventing the axle from moving out of said slot and the axle is held in said first and second axle receiving slots, said peninsula like member close enough to the bottom wall of said slot so its flexure caused by its engagement with an axle receiving slot is limited by the bottom wall of said first axle receiving slot and is well below its breaking point whereby the peninsula like member is independent of the weight carried by the suitcase, and means for rotating said slot in said one direction to free said axle from said slot.

3. An axle retaining bracket on a suitcase, said bracket having planar portions with transverse portions terminating in edges, each transverse portion having an axle receiving slot formed therein sized to receive the axle of a wheel assembly, each axle receiving slot having parallel walls connected by a bottom wall, a pivot, said pivot located at the center line between said walls, a lever mounted on said bracket on said pivot, said lever having a locking cam located near the entrance to said slot partially blocking the entrance to said axle receiving slot, said locking cam shaped so contact with an axle rotates said lever in one direction which moves said locking cam away from the entrance to said axle receiving slot permitting the axle to enter the slot, a thin peninsula like flexing means positioned to be engaged and flexed by an axle entering said slot, the flexure of said flexing means limited by the bottom wall of said slot, the bottom wall of said slot positioned with respect to said flexing means so the failure is below the breaking point of said flexing means whereby said flexing means is independent of the weight carried by the suitcase, at least part of said flexing means shaped so when an axle engages said flexing means, a rotative force is exerted on said lever in a direction opposite to said one direction moving said locking cam over the entrance to said first axle receiving slot thereby locking the axle in the slot, and means for moving said locking lever back in said one direction to permit the axle to be removed from said slot.

* * * * *